US006527197B1

(12) United States Patent
Lin

(10) Patent No.: US 6,527,197 B1
(45) Date of Patent: Mar. 4, 2003

(54) FOUNTAIN WITH A FLOAT INTERMITTENTLY MOVING UP AND DOWN

(76) Inventor: Chung-Kuei Lin, 6F-4, No. 1, Wuchuan 1st Rd., Wuku Industrial Dist., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/213,251

(22) Filed: Aug. 6, 2002

(51) Int. Cl.[7] ..... B05B 17/08

(52) U.S. Cl. ..... 239/20; 239/16; 239/17; 239/23; 239/99

(58) Field of Search ..... 239/16, 17, 18, 239/19, 20, 23, 99, 101, 211, 289, 193

(56) References Cited

U.S. PATENT DOCUMENTS 3,030,028 A * 4/1962 Hruby, Jr. ..... 239/17
5,011,372 A * 4/1991 Nigrelli et al. ..... 239/23
5,571,409 A * 11/1996 Scarborough ..... 239/20
6,416,197 B1 * 7/2002 Chang ..... 239/20

* cited by examiner

*Primary Examiner*—Robin O. Evans
(74) *Attorney, Agent, or Firm*—William E. Pelton, Esq.

(57) ABSTRACT

A fountain has a container receiving therein a battery, a micro chip, a pump electrically connected to the battery and operably controlled by the micro chip and a tube received in the container. A float is provided in the tube and is able to move upward and downward intermittently in the tube. The float further has extensions securely mounted on a top face of the float so that when the float is moving upward, the extensions, originally folded due to the confinement of the tube, extend to present an ornamental effect to the environment.

6 Claims, 3 Drawing Sheets

FOUNTAIN WITH A FLOAT INTERMITTENTLY MOVING UP AND DOWN

BACKGROUND OF THE INVENTION

1. Field of the Invention

The present invention relates to a fountain, and more particularly to a fountain with a float intermittently moving up and down in a channel defined in a tube so that decoration or commercial effect is presented.

2. Description of Related Art

A conventional fountain is equipped with a container for receiving therein water, a pump received in the container to pump the water and a guiding tube supported by the container to allow the pumped water to circulate between the guiding tube and the container. This kind of fountain does provide an ornamental effect to the environment though, it does not provide any extraordinary visual stimulus to the spectators. Even though fish may be kept in the container to provide visual enjoyment to the spectators, the conventional fountain still lacks actual "moving activity" to fit in the commercial society.

To overcome the shortcomings, the present invention tends to provide an improved fountain to mitigate and obviate the aforementioned problems.

SUMMARY OF THE INVENTION

The primary objective of the present invention is to provide an improved fountain with a float intermittently moving upward and downward so as to provide visual stimulus to the spectator.

In order to accomplish the foregoing objective, the fountain has a container receiving therein a battery, a micro chip, a pump electrically connected to the battery and operably controlled by the micro chip, a tube received in the container and a float to move upward and downward in the tube.

Another objective of the present invention is that the float has extensions securely mounted on a top face of the float so that when the float is moving upward, the extensions, originally folded due to the confinement of the tube, extend to present an ornamental effect to the environment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
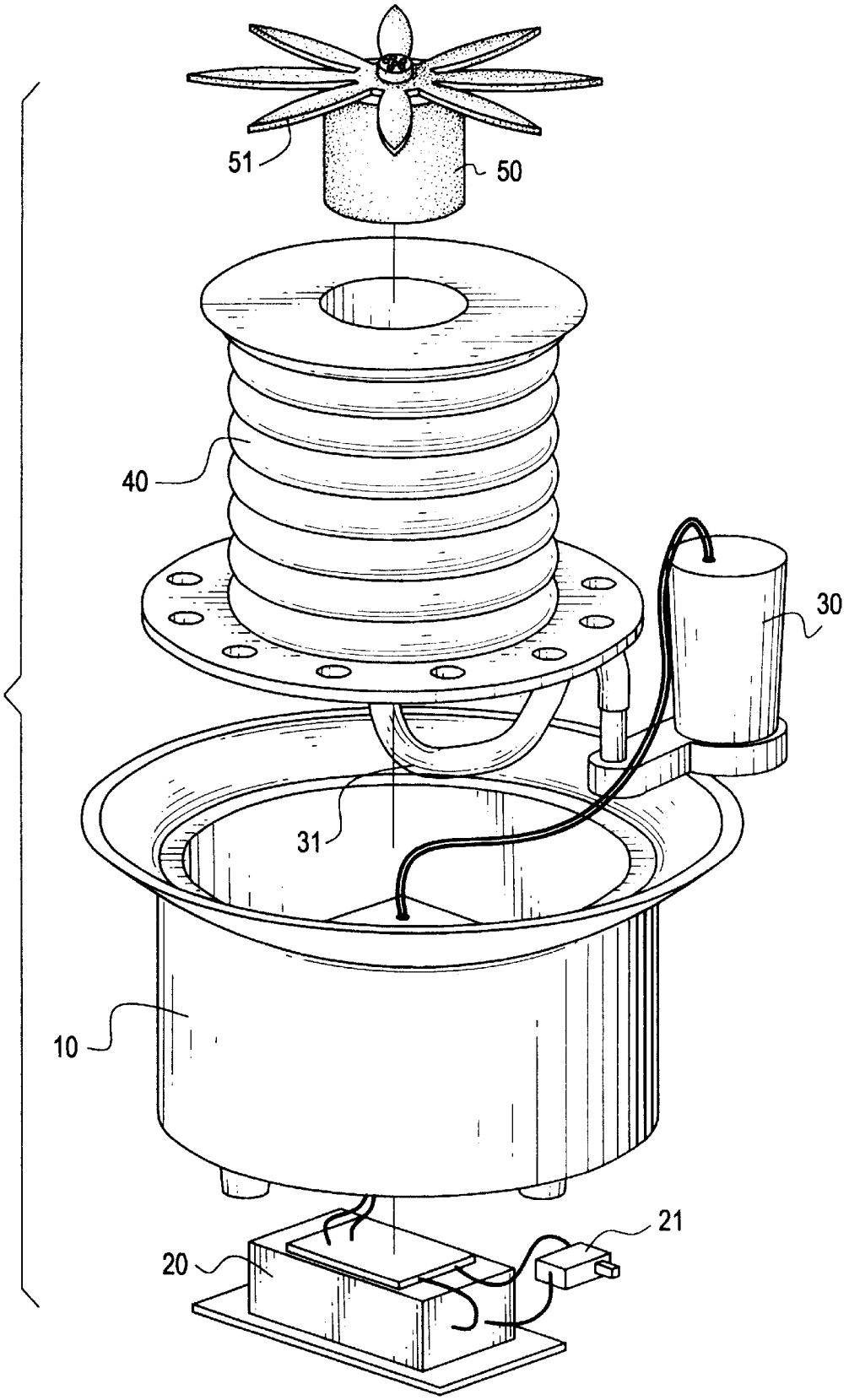
FIG. 1 is an exploded perspective view of the fountain of the present invention.
Figure 2:
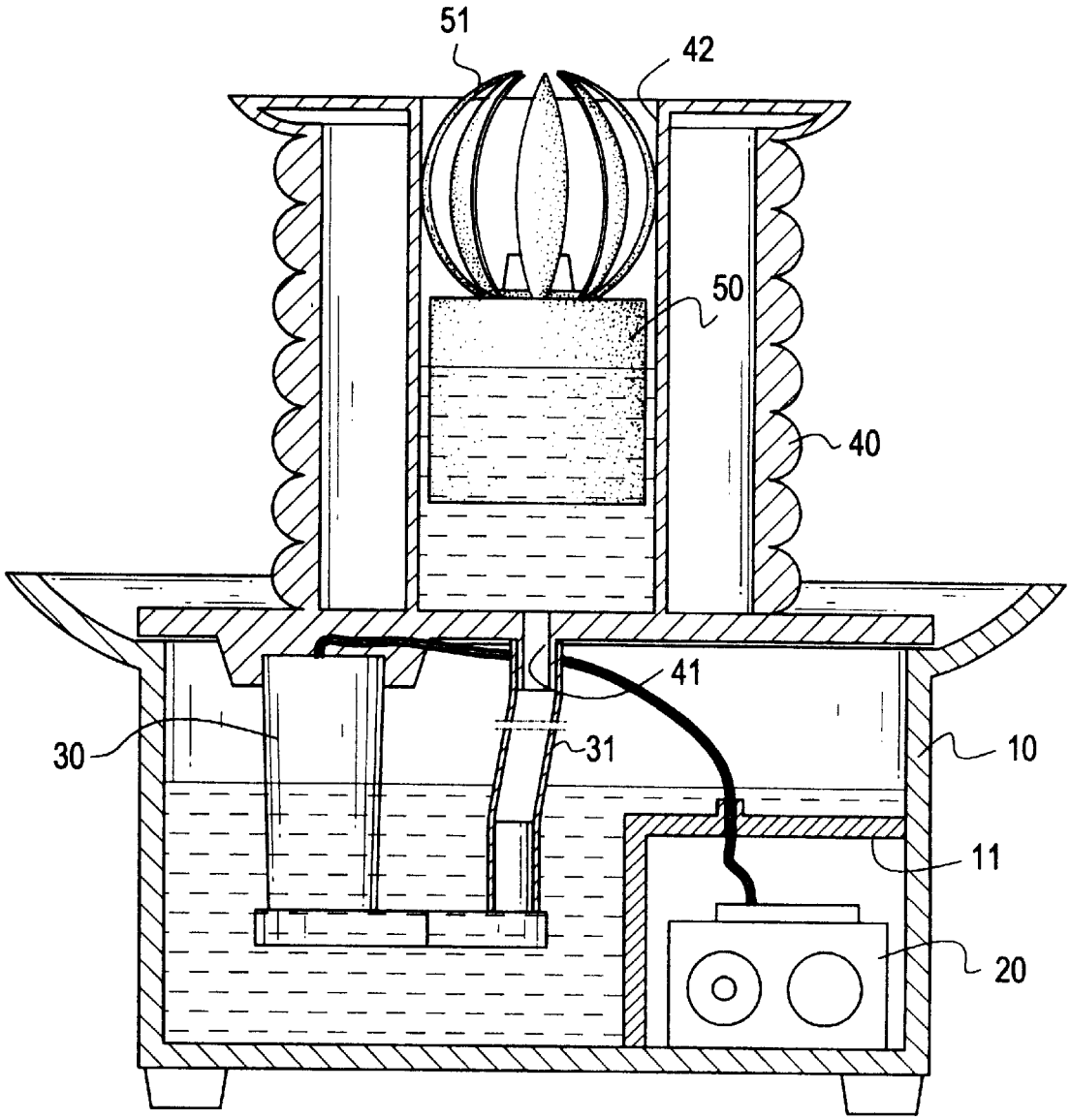
FIG. 2 is a schematic view showing the fountain in FIG. 1 in assembly.

With reference to FIGS. 1 and 2, the fountain in accordance with the present invention includes a container (10) receiving therein a battery (20), a micro chip (21), a pump (30) electrically connected to the battery (20) and operably controlled by the micro chip (21), a tube (40) received in the container (10) and a float (50) to move upward and downward in the tube (40).

The container (10) has a chamber (11) defined in the container (10) so that the battery (20) is able to be received in the chamber (11). The pump (30) is received in the container (10) and electrically connected to the battery (20). The micro chip (21) is also electrically connected to the pump (30) so that the micro chip (21) is able to activate the pump (30) intermittently. A hose (31) is connected between the pump (30) and a bottom of the tube (40). The tube (40) has a first opening (41) defined in the bottom of the tube (40) to communicate with the hose (31) and a second opening (42) communicating with the first opening (41). The float (50) is received in the tube (40) and has extensions (51) securely mounted on a top face of the float (50). The extensions (51) are divergently extending outward from a center of the top face of the float (50) so that the extensions (51) have a dimension larger than a diameter of the tube (40).

Figure 3:
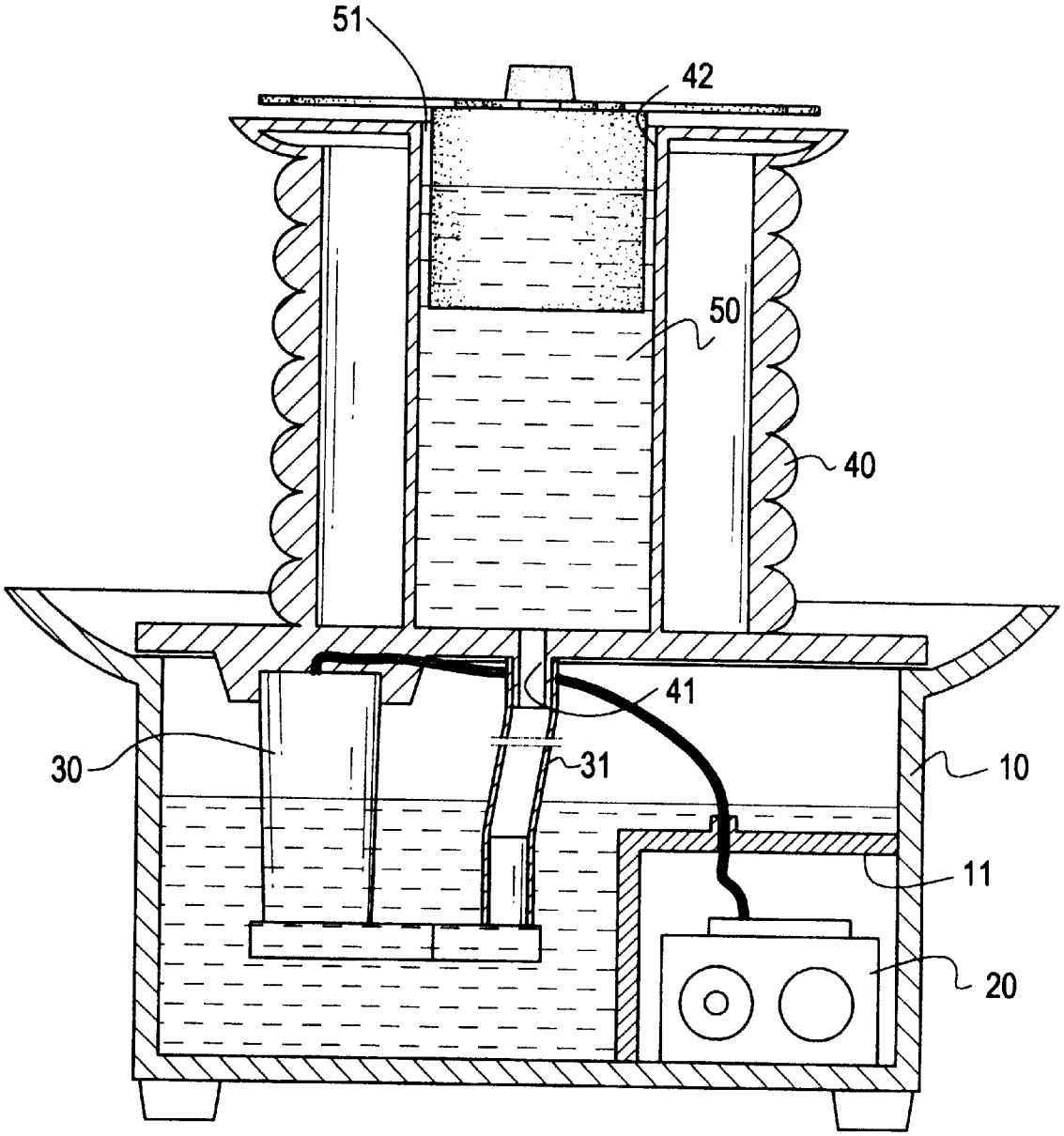
FIG. 3 is a schematic view showing the float is moving to the top of the tube and the extensions are unfolded.

With reference to FIG. 3 and still taking FIG. 2 for reference, when the fountain of the present invention is assembled, the battery (20) is received in the chamber ( 11) of the container (10) which has water received inside the container (10). The pump (30) is immersed in the water inside the container (10) and electrically connected to the battery (20). Due to the micro chip (21), the pump (30) is able to be intermittently activated. Furthermore, the float (50) is received in the tube (40) and the extensions (51) are folded due to the dimension confinement from the tube (40). However, when the pump (30) is activated, the pump (30) starts pumping water in the container (10) to the tube (40) via the hose (31). The float (50) is then gradually moved upward to the second opening (42) of the tube (40) due to the buoyancy of the float in the water. When the float (50) reaches the second opening (42) of the tube (40), the extensions (51) are unfolded so as to provide a visual enjoyment to the spectator. The water escaping from the second opening (42) of the tube (40) is recycled to flow to the container (10). That is, a diameter of the tube (40) is smaller than a diameter of the container (10), therefore, the water is recycled.

In another embodiment, the extensions (51) may be petals so that when the petals (51) are extended, a flower is presented.

Still, another application shows that the float (50) may carry a slogan or commercial ads. Therefore, the intermittent appearance of the commercial ads attracts a spectator's attention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fountain comprising:

a container for receiving therein water;

a battery received in a chamber defined in the container;

a micro chip electrically connected to the battery;

a pump for pumping the water, the pump being electrically connected to the battery and operably controlled by the micro chip so that the pump is intermittently activated by the micro chip;

a tube received and supported in the container; and a float intermittently moving upward and downward in the tube, whereby when the pump is activated by the micro chip to start pumping water into the tube, the float is moved upward due to buoyancy of the float in the water and the float is visible.

2. The fountain as claimed in claim 1, wherein the float has extensions securely mounted on a top face of the float, the extensions have a dimension larger than a diameter of the tube so that when the extensions are inside the tube, the extensions are folded and when the extensions are outside the tube, the extensions are unfolded.

3. The fountain as claimed in claim 1, wherein the tube has a first opening in communication with the pump by a hose and a second opening in communication with the first opening.

4. The fountain as claimed in claim 2, wherein the tube has a first opening in communication with the pump by a hose and a second opening in communication with the first opening.

5. The fountain as claimed in claim 2, wherein the extensions are divergently extending out from the top face of the float.

6. The fountain as claimed in claim 4, wherein the extensions are divergently extending out from the top face of the float.

* * * * *